US006182811B1

(12) United States Patent
Wei

(10) Patent No.: US 6,182,811 B1
(45) Date of Patent: Feb. 6, 2001

(54) JAM DETECTOR SYSTEM FOR COIN ESCROW DEVICE

(75) Inventor: Wenquan Wei, Sunnyvale, CA (US)

(73) Assignee: Tatung Telecom, Mountain View, CA (US)

( * ) Notice: Under 35 U.S.C. 154(b), the term of this patent shall be extended for 0 days.

(21) Appl. No.: 09/195,844

(22) Filed: Nov. 19, 1998

(51) Int. Cl.[7] ..... G07F 1/00
(52) U.S. Cl. ..... 194/200; 194/346
(58) Field of Search ..... 194/200, 244, 194/346; 379/145, 149, 152

(56) References Cited

U.S. PATENT DOCUMENTS 4,782,937 11/1988 Chen et al. ..... 194/346
5,135,433 * 8/1992 Watanabe et al. ..... 194/346 X
5,381,880 * 1/1995 Pearson ..... 194/217
5,799,768 * 7/1996 Bernier et al. ..... 194/346 X

FOREIGN PATENT DOCUMENTS 1-189796 * 7/1989 (JP) ..... 194/346

* cited by examiner

*Primary Examiner*—F. J. Bartuska
(74) *Attorney, Agent, or Firm*—Burns, Doane, Swecker & Mathis, LLP

(57) ABSTRACT

A coin escrow device has a coin jam detection mechanism that uses a magnetic switch. Magnets are connected to supports which move close to and away from the magnetic switch as a result of a coin deposit and the movement of the escrow device's gates. When a coin jam occurs, the magnets are positioned such that the magnetic switch is on.

21 Claims, 6 Drawing Sheets

FIG. 8A
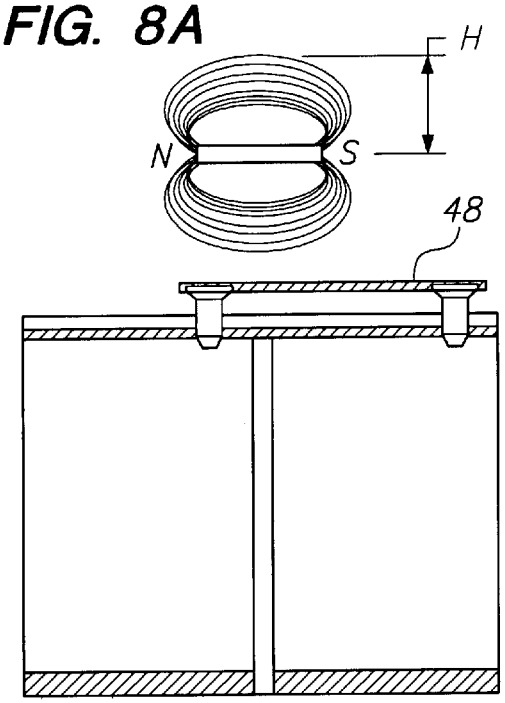
FIG. 8B
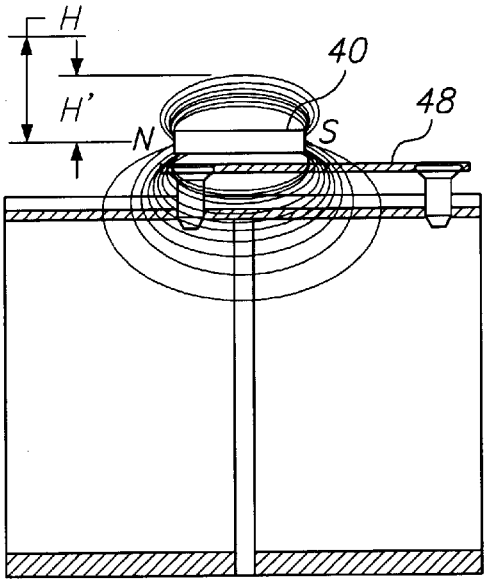
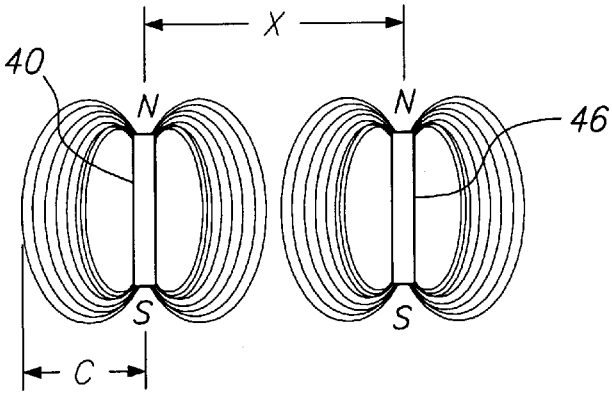
FIG. 9A
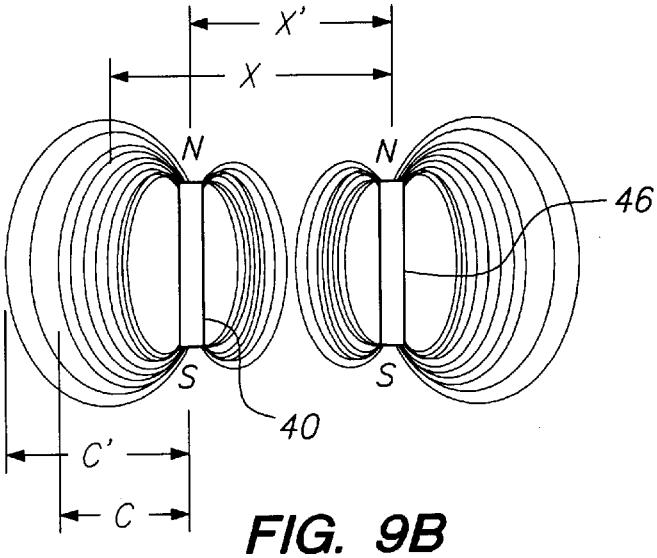
FIG. 9B

JAM DETECTOR SYSTEM FOR COIN ESCROW DEVICE

BACKGROUND OF THE INVENTION

1. Field of the Invention

The present invention generally relates to coin operated systems and, more particularly, to coin escrow devices for using coin operated systems such as vending machines, coin operated telephones, and the like.

2. State of the Art

Coin operated vending systems, such as coin operated telephones, often include devices, called "escrow" devices to temporarily hold coins until such time as control signals indicate whether the coin should be returned to the system user or permanently collected. Typical escrow devices in coin operated telephones include a mechanism to release the coins to a coin box in the event that a call has been successfully placed, and a mechanism to return coins to the calling party in the event that a call is not successfully completed.

Escrow devices for coin operated vending systems needs to be reliable. An escrow device must operate to discharge all escrowed coins to a collection box only when the vending operation has been successfully completed and, conversely, must return all escrowed coins to the system user only when a vending operation has not been successfully completed. If an escrow device does not operate reliably, the vending system may be damaged by an irrate user, or revenue can be lost to the owner of the system. U.S. Pat. No. 4,782,937 describes a prior art escrow device for coin operated systems. This patent is incorporated herein by reference.

In coin operated escrow systems, jamming is a common problem. For this reason, some coin escrow devices use jam detection circuitry. In prior art systems, electro-mechanical means have been employed to detect jamming within the coin escrow hopper using contact switches. When a coin deposit is detected, a contact switch is closed to tell the control electronic module that the coin escrow has activity. When a call connection is made or fails, a gate of the escrow hopper will open to accept or return the coins, and the contact switch will be reset to an open circuit position. If the coin escrow is jammed, the contact switch will remain closed and thus give a signal to the control electronic module that there is a coin jam. The use of contact switches can cause problems, however. Contact switches are subject to breakdowns due to air corrosion, electrochemical corrosion, or for mechanical reasons. To avoid the breakdown problems common with contact switches, some escrow systems do not use coin jam detection at all.

It is desired to have an improved system to detect jams in a coin escrow device.

SUMMARY OF THE INVENTION

Generally speaking, the present invention provides a coin escrow device using a magnetic switch in a jam detection mechanism. The magnetic switch can be enclosed, and thus there is no open connector which can be susceptible to corrosion or other failures common with contact switches. An example of a magnetic switch that can be used with the present invention is a reed switch. Magnets are moved close to and away from magnetic switch in a manner to indicate coin jams.

In one embodiment, a magnet on a support is moved from a normal position away from the magnetic switch to a position closer to the magnetic switch when a gate of the coin escrow device opens. An extension connected to the solenoid pushes-up on the support when the gate of the escrow device opens. The support drops down to its normal rest position when the gate closes. When the magnet comes close to the magnetic switch, the magnetic switch turns on and thus a signal is received by the controller. If a coin jams one of the gates open, the magnet will remain near the magnetic switch, keeping it on. Thus, the controller is notified of the coin jam.

Another support with another magnet can be moved down from its normal position away from the magnetic switch to a position near the magnetic switch by the coin trigger which indicates the receipt of a coin by the escrow device. When a gate of the escrow device is opened, the another support is moved up to its normal position. This is preferably done at the same time that the first support and first magnet are moved toward the magnetic switch. A jam can occur such that the coin is trapped in the region of the coin trigger. The coin trigger will prevent the support from returning to its normal position. This jam will be detected because the magnets will be positioned such that the magnetic switch is on.

In a preferred embodiment of the present invention, the first and second magnet and supports are used together to detect both types of coin jams. Alternatively, the system could use a single magnet to detect a single type of jam.

In one embodiment, the supports are connected at a pivot. The magnets are positioned at a tip of the supports so that they can swing out close to and away from the magnetic switch.

In one embodiment, a ferrous metal plate is placed near the normal position of the first magnet. This metal plate reduces the magnetic field of the first magnet in the direction of the magnetic switch when the first magnet is in its normal position. This can be important because the magnets and magnetic switches are typically produced to be within a relatively wide tolerance range.

In another embodiment, when the first and second magnets are near each other in an up position, the magnetic field is expanded in the direction towards the magnetic switch. This helps keep the magnetic switch on when the two magnets are in the up position.

BRIEF DESCRIPTION OF THE DRAWING

The present invention may be further understood from the following description in conjunction with the appended drawing. In the drawing:

FIGS. 8A and 8B are diagrams illustrating the effect of a metal plate when the bottom magnet is in its normal position.

FIGS. 9A and 9B are diagrams that illustrate the expansion of the magnetic field when the magnets are close to each other.

DETAILED DESCRIPTION OF THE PREFERRED EMBODIMENTS

Figure 1B:
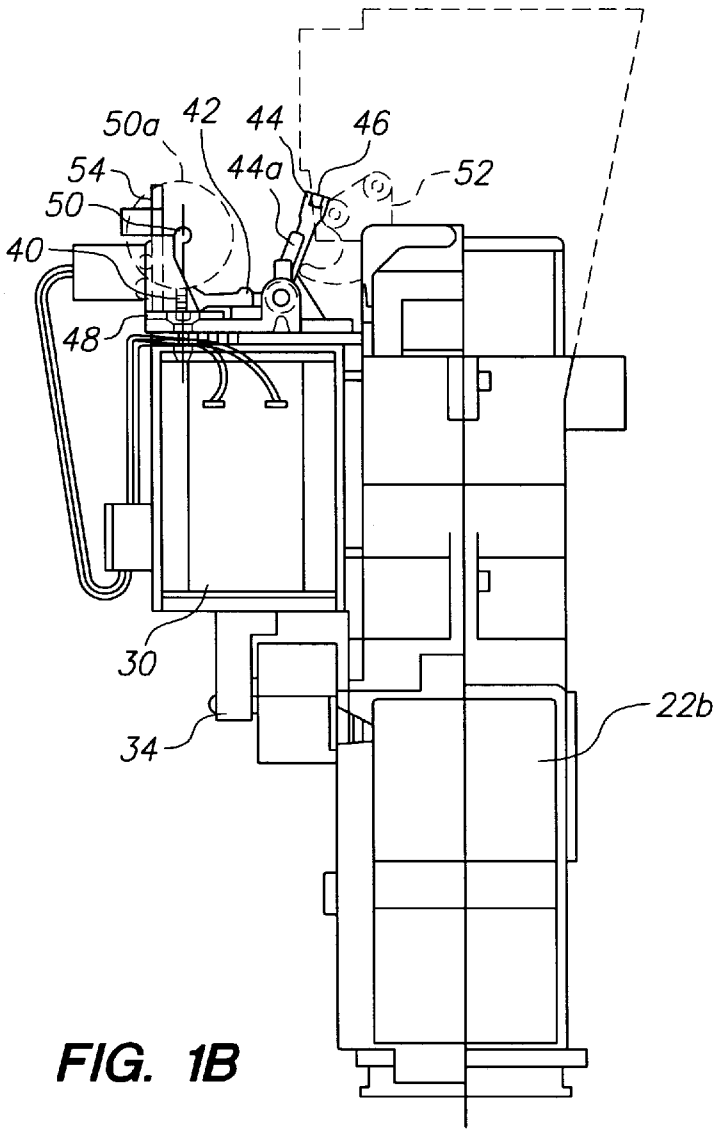
FIG. 1B is a diagram illustrating a side view of the coin escrow device of FIG. 1A with the magnets in their normal positions.

FIG. 1 is a diagram illustrating a front view of the coin escrow device of the present invention. Coin escrow device 20 includes a housing 22 used for containing the coins. Housing 22 includes a coin acceptance path 22*a*, and a coin return path 22*b*. When the left coin gate 24 opens, the coins in the escrow device are sent to the coin acceptance path 22*a*. When the right gate 26 opens, the coins are sent to the coin return path 22*b*. The gates 24 and 26 are opened and closed by the solenoids 28 and 30. Solenoid 28 causes plunger 32 to move up, opening the gate 24. Solenoid 30 causes plunger 34 to move up, opening the gate 26. When the solenoids are turned off, the plungers return to their rest positions, closing the gates 24 and 26. The plungers 32 and 34 have extension bars, or axles, 36 and 38 which are used for moving the magnets and the magnet supports.

The first magnet 40 is positioned in a first support 42. In a preferred embodiment, the first support 42 is sometimes called the small arm and second support 44 is sometimes called the flag. Second support 44 holds the second magnet 46. The second support 44 has a portion 44A which is contacted by the coin triggers to knock down the second support 44 when a coin is received. FIG. 1A is shown without the circuit board containing the magnetic switch.

Figure 1A:
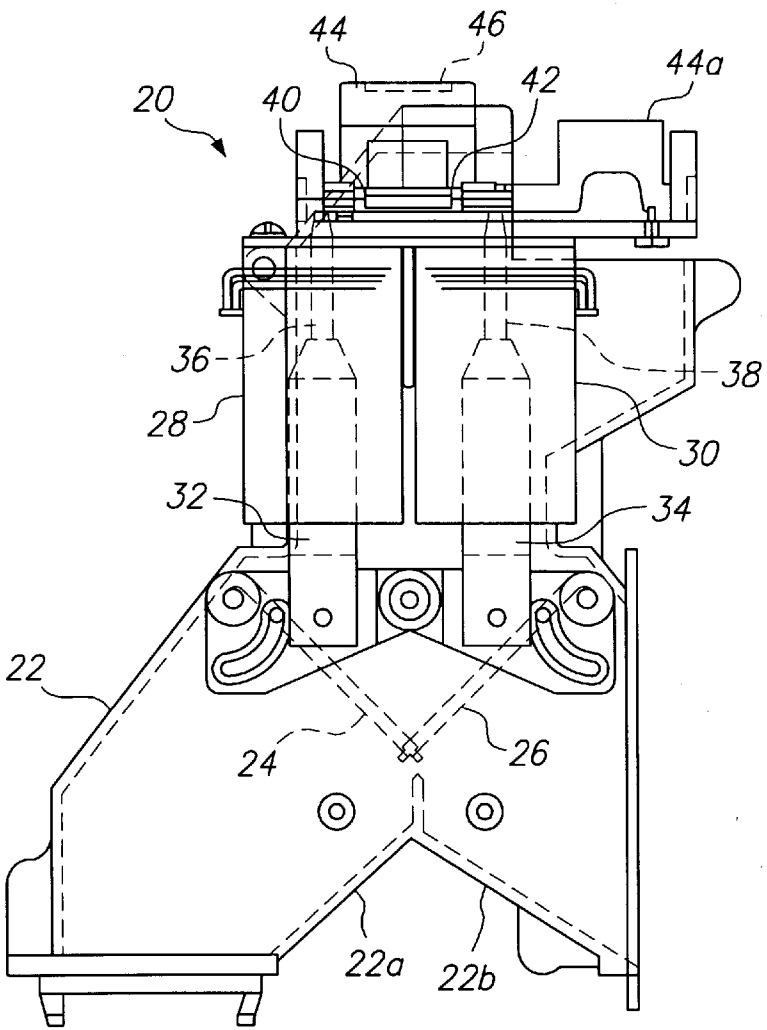
FIG. 1A is a diagram illustrating a front view of the coin escrow device of the present invention.

FIG. 1B is a diagram illustrating the side view of the coin escrow device of FIG. 1A. In the normal rest position, the magnet 40 is adjacent to the ferrous metal plate 48. The ferrous metal plate 48 is preferably connected through a metal screw to the metal casings of the solenoids. As is described in FIGS. 8A and 8B, the effect of the metal plate 48 is to reduce the magnetic field in the direction of the magnetic switch 50. The magnetic switch 50 is shown here with its magnetic switch control range 50*a* shown in phantom. The magnetic switch 50 is preferably a reed control switch. A reed control switch is an enclosed unit having two leads, one of the leads contacting the other in the presence of a high enough magnetic field.

In the normal position, the support 44 tilts away from the magnetic switch 50. The magnetic switch 50 is on the circuit board 54. Note that in FIG. 1B, in the normal position of the first and second supports 42 and 44, both the magnets 40 and 46 are out of the control range 50*a* of the switch 50 and thus the magnetic switch is off.

Figure 2:
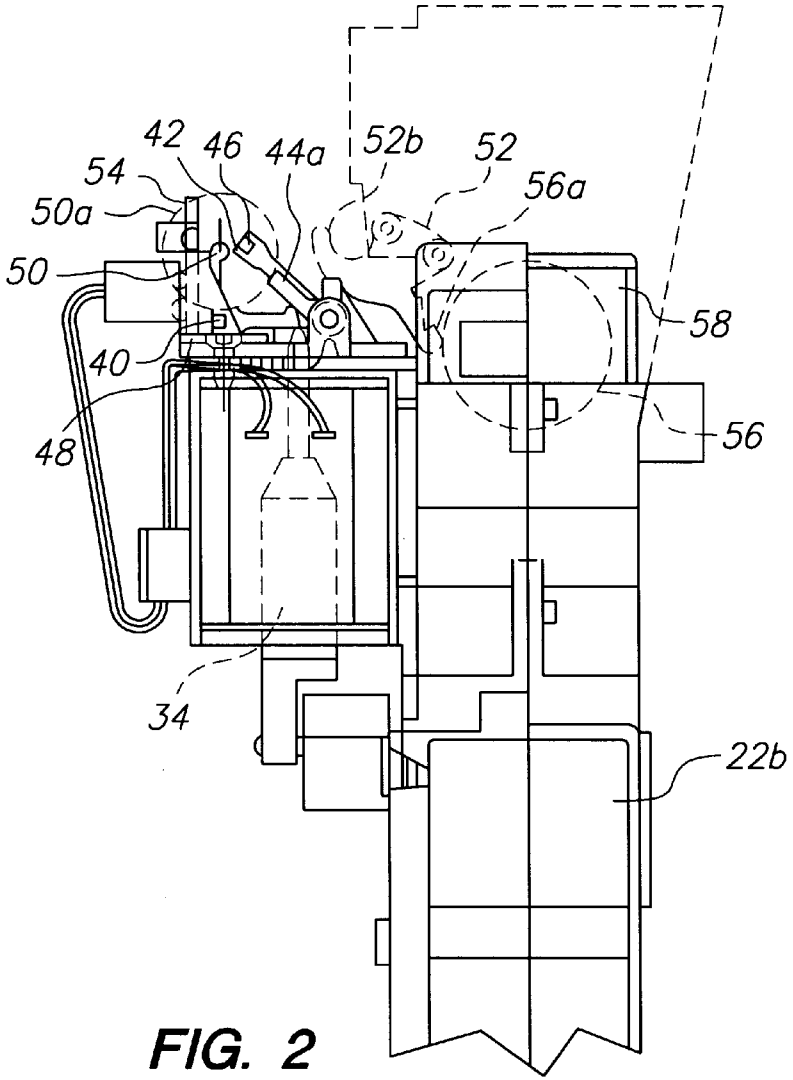
FIG. 2 is a diagram of a side view of the coin escrow device of FIG. 1, showing a coin positioned at the coin trigger causing the second magnet to move closer to the magnetic switch.

FIG. 2 is a diagram of the side view of the coin escrow device of FIG. 1 with the second support moved from its normal position to a position within the switch control range 50*a* of the magnetic switch 50. Coin 56 drops down the coin entrance 58, contacts the arm of the coin trigger 52, and rotates the coin trigger 52. Projection 52*b* of the coin trigger 52 pushes on the region 44*a* of the support 44. This causes the magnet 46 to drop within the control range 50*a* of the switch 50. In a preferred embodiment, the support 44 is kept tilted at an angle towards the switch 50 by the support 42.

Figure 3:
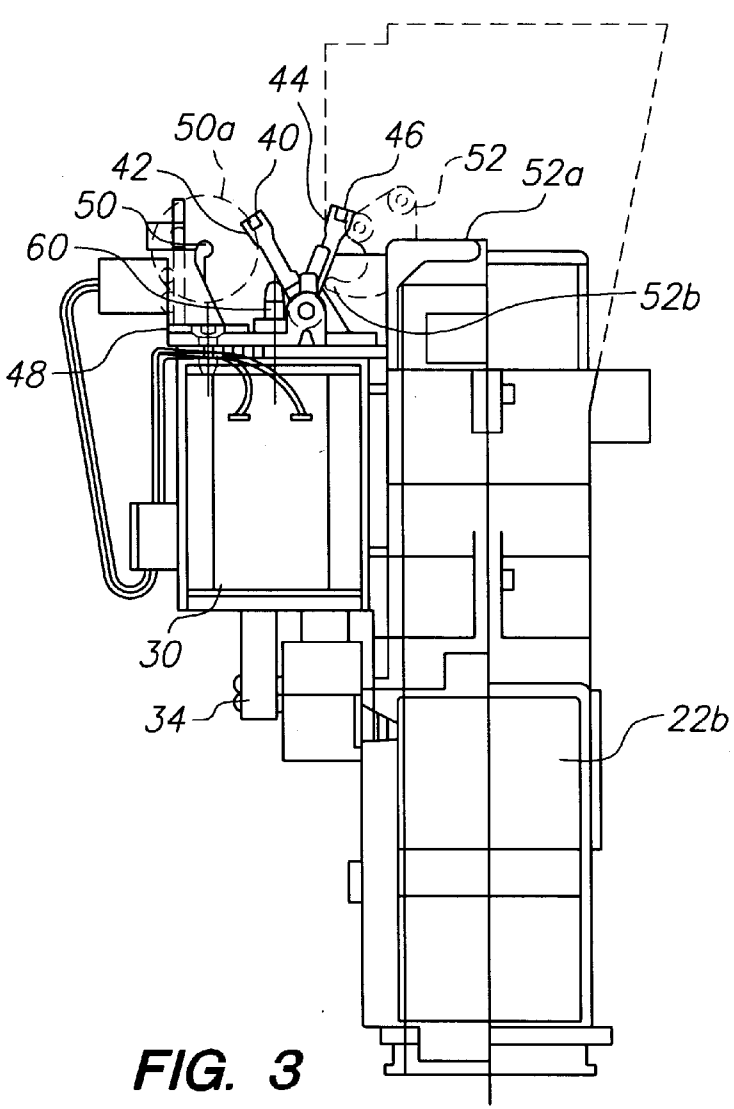
FIG. 3 is a diagram of the side view of the coin escrow device of FIGS. 1 and 2 with the axle of the solenoid pushing the first and second magnets upward when one of gates is opened.

FIG. 3 is a diagram illustrating the side view of the coin escrow device of FIGS. 1 and 2, where an extension 60 connected to the plunger 34 on the solenoid 30 pushes up the first support 42 and second support 44. When the plunger goes up, the gate associated with that plunger also opens up. In this position, the magnets 40 and 46 combine in their strengths to produce a strong enough magnetic field at the magnetic switch 50 to turn it on. A description of this effect is described below with respect to FIG. 9. When the gate is closed, the extension 60 lowers, and support 42 drops down to its normal position. The support 44 remains tiled away from the magnetic switch 50.

Figure 4A:
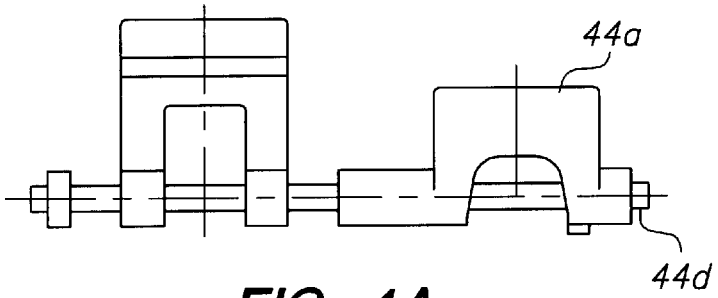
FIG. 4A is a top view of a support for one of the magnets used with the present invention.
Figure 4B:
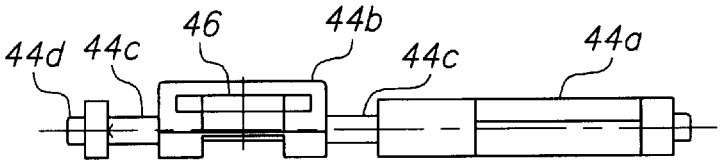
FIG. 4B is a front view of the support of FIG. 4A.
Figure 4C:
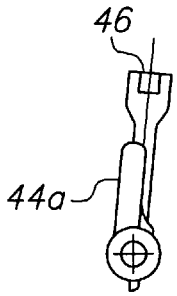
FIG. 4C is a side view of the support of FIG. 4A.

FIGS. 4A–4C show an embodiment of the second support 44 for the second magnet 46. Region 44*a* is positioned so that the coin trigger can knock down the support 44 and magnet 46. The support 44 has a sleeve 44*b* surrounding the magnet 46. The support 44 also has a shaft portion 44*c* onto which the support 42 can be attached. The ends 44*d* are adapted to be rotated in a pivot.

Figure 5A:
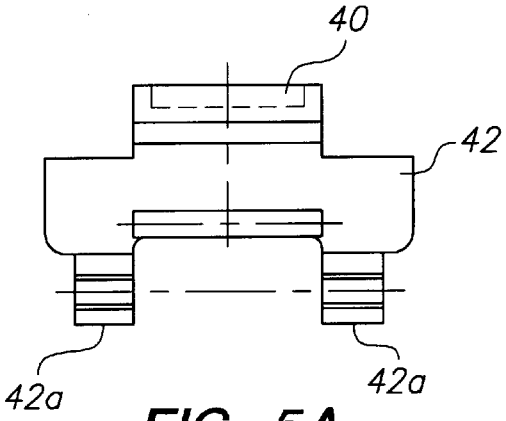
FIG. 5A is a top view of another support or another magnet of the present invention.
Figure 5B:
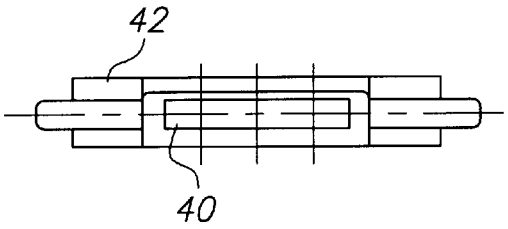
FIG. 5B is a front view of the support of FIG. 5A.
Figure 5C:
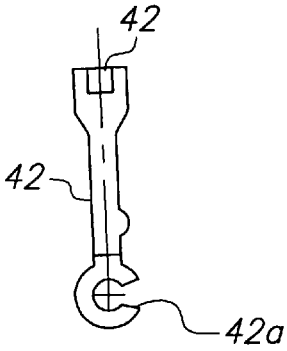
FIG. 5C is a side view of the support of FIG. 5A.

FIGS. 5A–5C shows the first support 42 with first magnet 40. The first support 42 includes sleeves 42*a* that surround the shaft 44*c* on the support 44. Thus, in a preferred embodiment, support 44 rotates in the pivot, and support 42 rotates about the shaft of support 44.

Figure 6:
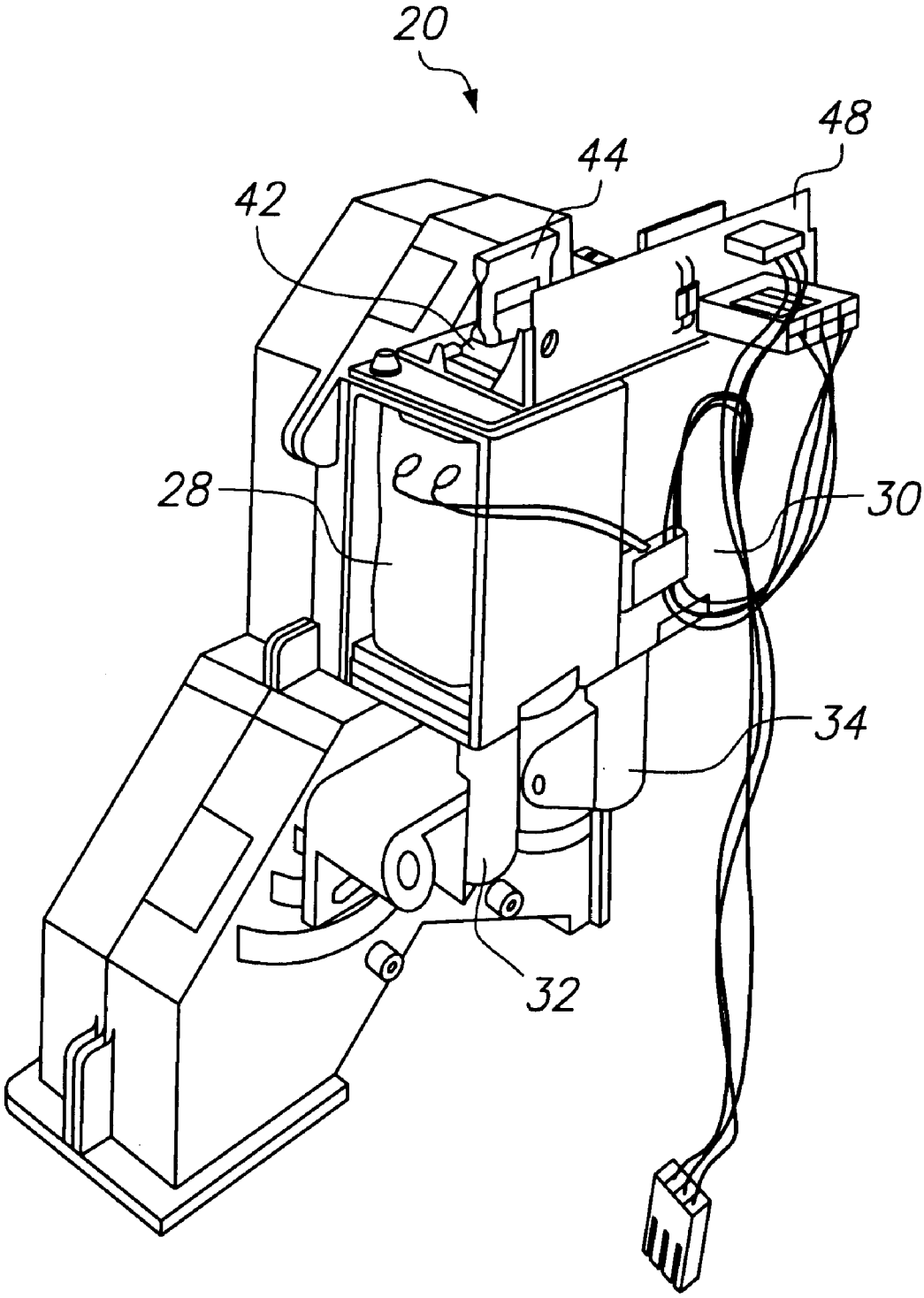
FIG. 6 is a perspective view of the coin escrow device of the present invention.

FIG. 6 is a diagram illustrating a perspective view of the coin escrow device 20.

Figure 7A:
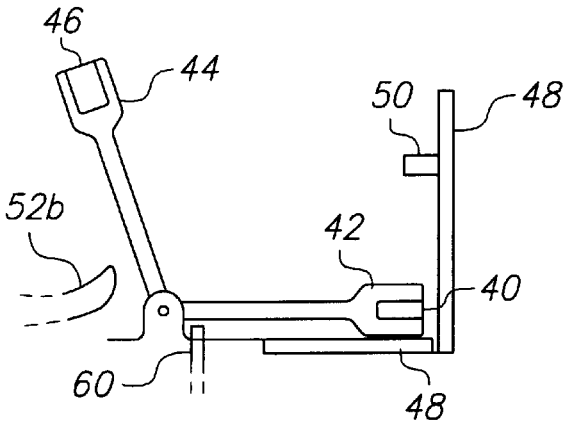
FIGS. 7A–7D are diagrams illustrating the positions of the magnets with respect to the magnetic switch.
Figure 7B:
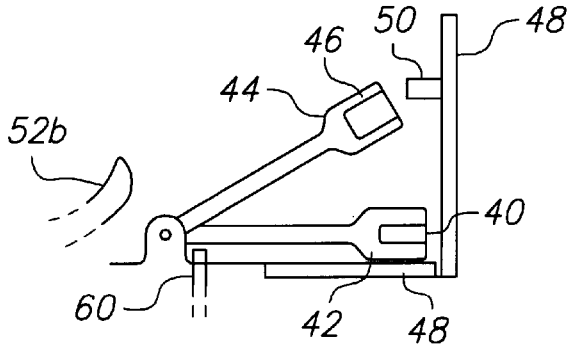
Figure 7C:
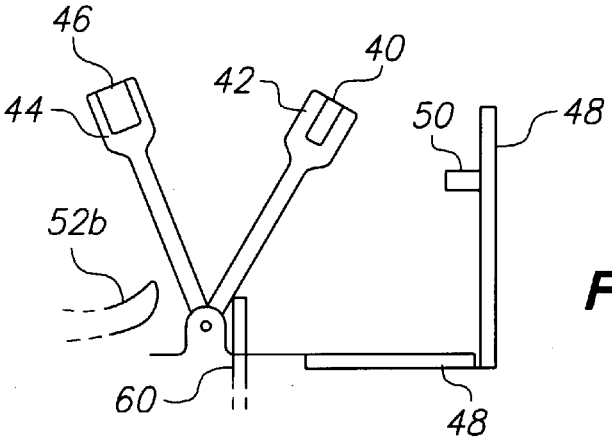
Figure 7D:
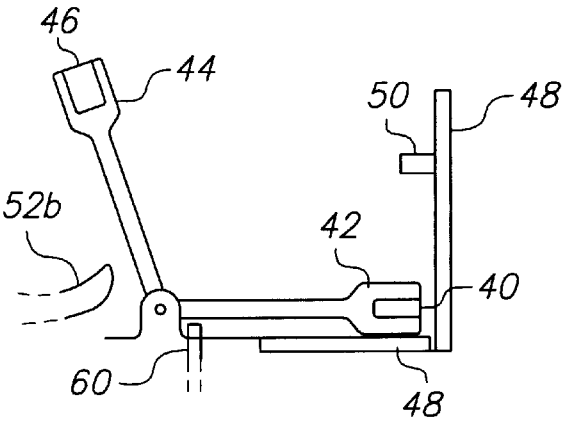

FIGS. 7A–7D are diagrams illustrating the operation of the magnetic switch. In unjammed operation, FIG. 7A shows magnets 40 and 46 in the normal position. The support 44 is tilted away from the magnet switch 50. The magnet 40 is resting adjacent to the ferrous metal plate 48. When a coin is detected, a portion of the coin trigger 52*b* pushes on the support 44 which falls down to the position shown in FIG. 7B. In this position, magnet 46 is near switch 50, and switch 50 turns on. When the solenoid causes a gate to be opened, an extension 60 connected to the plunger moves upward, pushing up both the supports 42 and 44. In the position of FIG. 7C, the switch 50 remains on. When the gate closes, extension 60 drops down as shown in FIG. 7D. In FIG. 7D, the magnetic switch 50 is off because magnets 40 and 46 are sufficiently away from the magnetic switch 50.

The system of the present invention can detect coin jams. For example, if a coin jams one of the gates open, the extension 60 will hold up supports 42 and 44 as shown in FIG. 7C. Since the controller has already sent the signal to control the gate to shut, when the controller receives the signal from the magnetic switch 50 that the switch remains on, it knows that there is a jam in the system. When the control board detects the signal, it will send a command making the solenoids respond with a movement. The movement can put the coin return and the escrow back to normal. If the coin jam is not removed, the phone will stop working and wait to be repaired.

When a coin jams at the coin trigger switch, region 52*b* of the coin trigger 52 will remain extended. Even when the gate tries to open and extension 60 attempts to rise, the magnets 40 and 46 will remain adjacent to the switch 50, leaving the magnet switch in the on state. When the control board detects the signal, as described above, it will send a command to the solenoids to respond with a movement. If this does not fix the coin jam, the system is shut down for examination.

FIGS. 8 and 9 illustrate the magnetic deformation effect used with the present invention. There are typically large tolerances in the operating forces required to switch the magnetic switch and the magnetic densities of the magnetic bars. These variables are very difficult to control during production. For this reason, the magnetic switch 50 cannot use a very precise control system. The present invention uses the principle of magnetic deformation to avoid this problem. FIG. 7A shows a magnet 40. When the magnet 40 is far away from the ferrous metal plate 48, and the housing of the solenoid, the magnetic field will extend to distance H at a given strength. When the magnet 40 becomes closer to the ferrous metal plate 48, the plate and housing of the solenoid acts as a magnetizer. The magnetic field will extend further into the magnetizer, but will shrink from a distance H to a distance H' in the direction away from the magnetizer. In this way, the precision of the control magnetic switch can be improved, because in the normal rest position, the magnetic field of the magnet 40 in the direction towards the magnetic switch is reduced as a result of the magnetizer comprising the metal plate 48 and the metal housing of the solenoids. This situation corresponds to that shown in FIGS. 7A and 7D.

FIGS. 9A and 9B illustrate the effect of the magnetic deformation when the two magnets 40 and 46 are moved closer to one another. In FIG. 9A, magnets 40 and 46 are a distance X apart from each other. The magnetic field of a given strength extends a distance C away from magnet 40. As shown in FIG. 9, as the magnets 40 and 46 come closer together to a distance of X', smaller than X, the distance of the magnetic field of a given strength expands from C to C'. This fact is exploited in the embodiment shown in FIG. 7C, in which the two magnets 40 and 46 combine to produce a greater magnetic field in the direction of the magnetic switch 50.

It will be appreciated by those of ordinary skill in the art that the invention can be embodied in other specific forms without departing from the spirit or central character thereof. For example, although the present invention describes pivotally rotated support members for the magnets, the system could be set up so that the magnets move towards and away from the magnetic switch by another means.

The presently disclosed embodiments are therefore considered in all respects to be illustrative and not restrictive. The scope of the invention is indicated only by the appended claims, rather than the foregoing description, and all changes which come within the meaning and range or the equivalence thereof are intended to be embraced therein.

What is claimed is:

1. A coin escrow device comprising:

a housing for receiving coins;

at least one gate connected to the housing having a closed position to support coins and an open position to discharge coins;

a magnetic switch; and a first magnet attached to a first movable support, wherein under unjammed conditions, when the gate opens, the first magnet is moved toward the magnetic switch from a normal position and when the gate closes, the first magnet moves back to the normal position of the first magnet, and wherein when a coin jam occurs, the magnet is outside its normal position and the magnetic switch is on;

said coin escrow device, further comprising a second magnet attached to a second movable support, the second support being operably connected to a coin trigger for detecting coins and to at least one solenoid operably connected to the gate for controlling the position of the gate such that, under unjammed conditions, when a coin is detected, the coin trigger moves the second magnet from a normal position toward the magnetic switch and the solenoid moves the second magnet back to the normal position of the second magnet when one of the gates is opened, wherein when a coin jam at the coin trigger occurs, the second magnet is outside its normal position and the magnetic switch is on.

2. A coin escrow device comprising:

a housing for receiving coins;

at least one gate connected to the housing having a closed position to support coins and an open position to discharge coins;

a magnetic switch; and a first magnet attached to a first movable support, wherein under unjammed conditions, when the gate opens, the first magnet is moved toward the magnetic switch from a normal position and when the gate closes, the first magnet moves back to the normal position of the first magnet, and wherein when a coin jam occurs, the magnet is outside its normal position and the magnetic switch is on;

said coin escrow device, further comprising a ferrous-metal plate adjacent to the normal position of the first magnet, wherein when the first magnet is in the first position, the ferrous-metal plate reduces the magnetic field of the first magnet in the direction of the magnetic switch.

3. A coin escrow device comprising:

a housing for receiving coins;

at least one gate connected to the housing having a closed position to support coins and an open position to discharge coins;

a magnetic switch; and a first magnet attached to a first movable support, wherein under unjammed conditions, when the gate opens, the first magnet is moved toward the magnetic switch from a normal position and when the gate closes, the first magnet moves back to the normal position of the first magnet, and wherein when a coin jam occurs, the magnet is outside its normal position and the magnetic switch is on;

said coin escrow device, wherein, under unjammed conditions, the first support drops under gravity after a gate closes.

4. A coin escrow device comprising:

a coin trigger switch for detecting the presence of coins;

a housing for receiving coins;

gates connected to the housing each having a closed position to support coins and an open position to discharge coins;

at least one solenoid operatively connected to the gates to control the position of the gates;

a magnetic switch; and a magnet attached to a movable support, the support being operably connected to the coin trigger and to the at least one solenoid such that, under unjammed conditions, when a coin is detected, the coin trigger moves the magnet from a normal position toward the magnetic switch and the solenoid moves the magnet back to the normal position of the magnet when one of the gates is opened, wherein when a coin jam at the coin trigger occurs, the magnet is outside its normal position and the magnetic switch is on.

5. The coin escrow device of claim 4, further comprising another magnet attached to another movable support, the another support being operably connected to the at least one solenoid so that, under unjammed conditions, when one of the gates opens, the another magnet moves toward the magnetic switch from a normal position of the another magnet and when the gate closes, the another magnet moves back to the normal position of the another magnet.

6. The coin escrow device of claim 4, wherein the support is rotatable about a pivot.

7. The coin escrow device of claim 4, wherein in the normal position of the magnet, the support leans away from the from the magnetic switch.

8. A coin escrow device comprising:

a coin trigger switch for detecting the presence of coins;

a housing for receiving coins;

gates connected to the housing each having a closed position to support coins and an open position to discharge coins;

at least one solenoid operatively connected to the gates to control the position of the gates;

a magnetic switch;

a first magnet attached to a first movable support, the first support being operably connected to the at least one solenoid so that, under unjammed conditions, when one of the gates opens, the first magnet moves from a normal position of the first magnet toward the magnetic switch and when the gate closes, the first magnet moves back to the normal position of the first magnet; and a second magnet attached to a second movable support, the second support being operably connected to the coin trigger and to the at least one solenoid such that, under unjammed conditions, the coin trigger moves the second magnet from a normal position of the second magnet toward the magnetic switch when a coin is detected and the solenoid moves the second magnet back to the normal position of the second magnet when one of the gates is opened, wherein when a coin jam occurs one of the first or second magnets is outside its normal position and the magnetic switch is on.

9. The coin escrow device of claim 8, further comprising a ferrous-metal plate adjacent to the normal position of the first magnet, wherein when the first magnet is in the first position, the ferrous-metal plate reduces the magnetic field of the first magnet in the direction of the magnetic switch.

10. The coin escrow device of claim 8, wherein when the first magnet is in a top position and the second magnet is in its normal position, the magnetic field of the magnets expands in the direction of the magnetic switch.

11. The coin escrow device of claim 8, wherein the first and second supports are rotatable about a pivot.

12. The coin escrow device of claim 11, wherein the first and second magnets are in a tip of the first and second supports that is positioned away from the pivot.

13. The coin escrow device of claim 8, wherein the first support is positioned below the second support.

14. The coin escrow device of claim 8, wherein in the normal position of the second magnet the second support leans away from the from the magnetic switch.

15. The coin escrow device of claim 8, wherein a coin jam at one of the gates can be detected by the magnetic switch when the first magnet is outside its normal position after a control signal to close the gate has been given.

16. The coin escrow device of claim 8, wherein when a coin jam at the coin trigger occurs, the second magnet is outside its normal position and can be detected by the magnetic switch.

17. The coin escrow device of claim 8, wherein the solenoid includes axle adapted to push up the first support when a gate opens.

18. The coin escrow device of claim 8, wherein, under unjammed conditions, the first support drops under gravity after a gate closes.

19. A coin escrow device comprising:

a housing for receiving coins;

gates connected to the housing each having a closed position to support coins and an open position to discharge coins;

at least one solenoid operatively connected to the gates to control the position of the gates;

a magnetic switch; and a first magnet attached to a first movable support, the first support being operably connected to the at least one solenoid so that, under unjammed conditions, when one of the gates opens, the first magnet moves toward the magnetic switch from a normal position and when the gate closes, the first magnet moves back to the normal position of the first magnet, further comprising a ferrous-metal plate adjacent to the normal position of the first magnet, wherein when the first magnet is in the normal position, the ferrous-metal plate reduces the magnetic field of the first magnet in the direction of the magnetic switch.

20. A coin escrow device comprising:

a housing for receiving coins;

gates connected to the housing each having a closed position to support coins and an open position to discharge coins;

at least one solenoid operatively connected to the gates to control the position of the gates;

a magnetic switch; and a first magnet attached to a first movable support, the first support being operably connected to the at least one solenoid so that, under unjammed conditions, when one of the gates opens, the first magnet moves toward the magnetic switch from a normal position and when the gate closes, the first magnet moves back to the normal position of the first magnet, wherein, under unjammed conditions, the first support drops under gravity after a gate closes.

21. A coin escrow device comprising:

a housing for receiving coins;

at least one gate connected to the housing having a closed position to support coins and an open position to discharge coins;

a magnetic switch; and a first magnet attached to a first movable support and a second magnet attached to a second movable support, wherein under unjammed conditions, when the gate opens, the first magnet is moved toward the magnetic switch from a normal position and the second magnet is moved to a ready position and when the gate closes, the first magnet moves back to the normal position of the first magnet, and wherein when a coin is detected the second magnet moves to a position adjacent to the magnet switch and wherein when a coin jam occurs, the first magnet is outside its normal position and the magnetic switch is on.

* * * * *